US008893540B2

(12) United States Patent
Gerlach et al.

(10) Patent No.: US 8,893,540 B2
(45) Date of Patent: Nov. 25, 2014

(54) METHOD AND TOOL FOR PRODUCING A COMPONENT AND A COMPONENT PRODUCED BY FORMING

(75) Inventors: Lars Gerlach, Esslingen (DE); Michael Werbs, Hannover (DE); Andreas Bawohl, Baindt (DE); Karl Geisinger, Meckenbeuren (DE)

(73) Assignee: Schuler Cartec GmbH & Co. KG, Goppingen (DE)

( * ) Notice: Subject to any disclaimer, the term of this patent is extended or adjusted under 35 U.S.C. 154(b) by 0 days.

(21) Appl. No.: 13/589,497

(22) Filed: Aug. 20, 2012

(65) Prior Publication Data

US 2013/0040161 A1 Feb. 14, 2013

Related U.S. Application Data

(63) Continuation of application No. PCT/EP2011/000783, filed on Feb. 18, 2011.

(30) Foreign Application Priority Data

Feb. 25, 2010 (DE) ..... 10 2010 009 345

(51) Int. Cl.

| | |
|---|---|
| ***B21D 22/00*** | (2006.01) |
| ***B21J 5/08*** | (2006.01) |
| ***B21K 1/30*** | (2006.01) |
| ***B21J 9/06*** | (2006.01) |
| ***B21K 21/12*** | (2006.01) |

(52) U.S. Cl.

CPC ... *B21K 1/30* (2013.01); *B21J 5/08* (2013.01); *B21J 9/06* (2013.01); *B21K 21/12* (2013.01)

USPC ..... 72/353.2; 72/354.2; 72/355.2

(58) Field of Classification Search

USPC ..... 72/348, 352, 353.2, 354.2, 354.6, 72/354.8, 355.2, 355.4, 342.1, 379.2, 58, 72/61, 364

See application file for complete search history.

(56) References Cited

U.S. PATENT DOCUMENTS

| | | | | | |
|---|---|---|---|---|---|
| 1,560,135 | A | * | 11/1925 | Bell | 72/353.2 |
| 1,711,182 | A | * | 4/1929 | Shrum | 72/353.2 |
| 2,120,595 | A | * | 6/1938 | Ash | 72/336 |
| 2,654,944 | A | * | 10/1953 | Wilson | 29/893.34 |
| 3,335,590 | A | * | 8/1967 | Early | 72/58 |
| 4,397,345 | A | * | 8/1983 | Ramaratnam et al. | 152/406 |
| 4,782,679 | A | | 11/1988 | Bögel | |

(Continued)

FOREIGN PATENT DOCUMENTS

| | | |
|---|---|---|
| DE | 1 087 433 B | 8/1960 |
| DE | 34 09 549 A1 | 9/1985 |

(Continued)

OTHER PUBLICATIONS

International Search Report dated Jun. 15, 2011.

*Primary Examiner* — Edward Tolan
(74) *Attorney, Agent, or Firm* — Burr & Brown, PLLC

(57) ABSTRACT

The invention relates to a component, a method, and a tool for forming, in particular for the lateral extrusion or upsetting of thin-walled preforms to form components having a structure formed thereon, in particular having a toothing, wherein, by carrying out the method according to the invention and by using the tool according to the invention, buckling of the wall of the preform during the forming process to form the component according to the invention is prevented.

19 Claims, 20 Drawing Sheets

(56) References Cited

U.S. PATENT DOCUMENTS

| | | | | |
|---|---|---|---|---|
| 5,068,964 | A * | 12/1991 | Yabuno et al. | 29/892.3 |
| 5,265,335 | A * | 11/1993 | Kawagoe et al. | 29/898.058 |
| 6,082,166 | A * | 7/2000 | Marin | 72/348 |
| 6,931,906 | B2 * | 8/2005 | Sorgi | 72/370.03 |
| 8,015,852 | B2 * | 9/2011 | Su | 72/348 |
| 8,321,884 | B2 * | 11/2012 | Suzuki | 720/712 |
| 8,499,607 | B2 * | 8/2013 | Kleber et al. | 72/379.6 |
| 2008/0309834 | A1 * | 12/2008 | Yi et al. | 348/818 |
| 2010/0083782 | A1 * | 4/2010 | Cheisa et al. | 74/458 |

FOREIGN PATENT DOCUMENTS

| | | | | |
|---|---|---|---|---|
| DE | 37 18 884 | A1 | 12/1988 | |
| EP | 0441174 | A2 * | 8/1991 | B21D 41/00 |
| FR | 917 776 | A | 1/1947 | |

* cited by examiner

METHOD AND TOOL FOR PRODUCING A COMPONENT AND A COMPONENT PRODUCED BY FORMING

CROSS REFERENCE TO RELATED APPLICATIONS

This application is a continuation of International Application No. PCT/EP2011/000783 filed Feb. 18, 2011, which designated the United States, and claims the benefit under 35 USC §119(a)-(d) of German Application No. 10 2010 009 345.9 filed Feb. 25, 2010, the entireties of which are incorporated herein by reference.

FIELD OF THE INVENTION

The application relates to a method for producing a component from a metal material, a tool for producing a component by forming, and a mechanical component produced by forming.

BACKGROUND OF THE INVENTION

The possibilities for use of mechanical components, in particular mechanical gearwheels, in the field of mechanical engineering are practically endless. When considering the category of gearwheels by way of example, these often have to be produced with considerable manufacturing effort, for example by machining a solid body.

An alternative to machining is provided by the possibility of forming by cold, warm, and hot lateral extrusion or upsetting, in which a component is compressed along a first spatial direction by the application of considerable compressive forces, wherein, due to this compression, the material flows into cavities which are provided by a tool transverse to the first spatial direction. A method of this type is described, for example, in DE 37 18 884 A1.

The approach described in DE 37 18 884 A1 is only applicable, however, to a limited number of preforms to be formed, since a considerable amount of pressure has to be exerted onto the component along the direction of compression to achieve the lateral extrusion process. If, however, contrary to the teaching of DE 37 18 884 A1, a preform formed from a solid material is not inserted into the tool, but instead a thin-walled hollow body, for example, a tube portion or a beaker-shaped hollow body is to be formed, the dimension of the structure which is provided by the tool through the cavities and which is to be filled with material by the lateral extrusion process, is extremely limited. The reason for this lies primarily in the fact that the larger the structure to be filled, the greater the risk of buckling of the thin wall of the preform in the region of the structure at the start of the forming process. In accordance with the invention, only thin-walled preforms in which the available wall height of the preform x is at most 2.3 times the initial wall thickness t1 can therefore be used for the production of components of this type. Otherwise, there is a risk of buckling, which has serious effects on the properties of the component produced.

DE 34 09 549 A1 describes a method for producing flanges or collars on hollow parts by lateral extrusion, wherein the material is supported in the hole during the extrusion process by a plastically acting tool. The disadvantage of this method lies in the use of a hollow body as a preform, which is merely to be used for the production of a structure of limited dimension and, in addition, cannot produce a precisely defined geometry with the plastic support body.

DE 1 087 433 B describes the production of a hub body for freewheel brake hubs formed from a seamless tube portion by cold extrusion. In this case, too, the disadvantage is the production of a structure (spoke flange) of limited dimension due to the use of a hollow body as a preliminary workpiece (preform) without use of a support element.

SUMMARY OF THE INVENTION

The object of the invention is therefore to provide a method and a device, with which a component can be produced from a thin-walled preform by forming, wherein buckling is avoided, even with a relatively large ratio of the height of the preform to the wall thickness thereof. A further object of the present invention is to develop a component produced by forming, the component being produced in accordance with the method according to the present invention and using a device according to the present invention.

The core of the method according to the present invention lies in the fact that, within the scope of the forming process, support bodies support the wall regions of the preform to be formed at all points where there should be no material movement into a die cavity as a result of the forming process. Only the region of the die cavity is thus to be taken into consideration for buckling, wherein practically any wall height of the preform can be selected, that is to say a considerable amount of material can be provided as volume to be formed.

Individual areas of the formed component may have a wall thickness which remains constant compared to the preform, for example, in the region of the teeth roots of a gearwheel, while other areas are characterized by an increase in wall thickness, for example, the formed teeth of a gearwheel.

To carry out the method according to the present invention, it is conceivable for a support body having a die cavity adjacent thereto to be formed as a one-piece component part of a forming installation. Separate component parts can also be implemented in expedient embodiments.

Only the primary components for lateral extrusion or upsetting relevant to the present invention will be mentioned hereinafter as an alternative to the complex forming process consisting of different components.

Within the scope of the component to be produced in accordance with the present invention, the component can be divided into a support and a structure.

If the component and the preform are projected into one another, the sectional volume, that is to say the volume enclosed by the component and preform, thus forms the support of the component, and the remaining volume of the component forms the structure of the component. The virtual interface between the support and the structure is the support surface.

Within the scope of the component to be produced in accordance with the present invention, this component comprises a support, which, for example, is present in the form of a cup, and in turn comprises a support surface which is to be considered as a peripheral outer surface around the support. The structure produced on the component, which, for example, may constitute a peripheral thickening or partially or fully formed teeth of a gearwheel, is formed on this support surface. More detailed explanations are also presented in the exemplary embodiment further below.

An applied thickening over the support surface may, for example, be implemented by means of the method according to the present invention with an increase in wall thickness of 10% up to 50% or 100% or more.

The at least partially peripheral structure, which constitutes formed teeth of a gearwheel or a peripheral thickening, in which recesses for forming teeth can be formed subsequently in a further processing step and, in particular, can be milled in, is formed by the method according to the present invention. To produce a component of this type, a cup-shaped preform is placed in a tool according to the present invention, which, when carrying out the method for forming a structure without additional wall construction with the part of the wall of the preform which carries the structure in the subsequent component, constitutes the resultant support surface.

To produce a component in accordance with the present invention, a preform placed in a tool and of which the wall to be formed has a first wall height x is upset to a second, smaller wall height, wherein, if the second height corresponds exactly to the wall height of the peripheral structure to be produced, the upset volume elements are displaced by lateral extrusion or upsetting into a die cavity, which basically constitutes a negative of the structure to be produced. Of course, it is to be assumed that the die cavity does not necessarily have to be filled completely by displaced material, since a considerable curvature of the inflowing material would otherwise have to be achieved, for example, in the region of right-angled edges, which is not absolutely necessary or even possible in a forming process.

It is also conceivable, however, that the structure to be formed is not upset as far as the entire height thereof, and therefore a region which has no increase in thickness or merely a peripheral wall thickening compared to the wall of the preform thus remains outside the structure. This can preferably be implemented above or below the structure to be formed, or on both sides.

The method according to the present invention is used primarily in the production of components in which large regions are thin-walled and other regions are thicker, and which, for example, are to be manufactured from a sheet metal blank. It is mentioned by way of example that, in a development of the method according to the invention, the preform is produced in a preparatory step by forming, preferably by deep-drawing, from a planar blank, preferably a sheet metal. The preform thus produced is L-shaped in a segment section, for example, in the region of a segment of a circle of a beaker shape or of a cross section of an L-profile. In particular, a U-shaped cross-sectional symmetry is to be used for consideration of the beaker shape if a type of beaker or cup is produced from a planar blank. Cup shapes of this type can be formed, for example, as a circular or elliptical shape, wherein a completely irregular body shape can also be formed with the peripheral wall of the cup, for example, so as to produce eccentric gearwheel shapes. Besides its peripheral wall, the cup produced has a base which preferably is not completely closed, wherein the opening in the base can be used to subsequently receive a hub or for positioning in the forming tool. A simple possibility for production of a preform from a planar blank is thus provided, whereby considerable degrees of freedom are achieved for the resultant component to be produced, and therefore elliptical or freely selectable gearwheel shapes, for example, can be produced.

In a development of the method according to the present invention, the preform is heated before and/or during the shaping process so as to carry out warm-forming or hot-forming. Depending on the material used, the lateral extrusion process can thus be optimized during the forming operation so that the required application of force and/or the structure achieved lie within predefined optimal parameters. The temperature to be selected for warm-forming or hot-forming is dependent on the respective materials used, for example steel or aluminum, and the variables known from the technical literature for the respective workpiece temperatures. According to VDI 3166 (April 1977), a temperature range of 200° C. to 850° C., for example, is recommended for the warm-forming of steel.

In a further development according to the method of the present invention, the position of a wall support body is held in a stationary manner relative to a base surface of the preform during the forming process. Due to the stationary positioning of a wall support body, the mechanical structure of the tool is simplified and, in particular, jamming caused by mechanical components to be moved past one another is prevented.

In a further development according to the method of the present invention, the position of at least one wall support body adjacent to the die cavity relative to a base surface of the preform is changed during the forming process, preferably by movement of the wall support body parallel to and in relation to the movement of at least one punch. As a result of this corresponding development, it is possible for the die cavity forming the structure and which is to be filled with material by lateral extrusion or upsetting to also be moved along the wall height of the preform during the forming process.

The average distance which has to be covered in the structure by a volume element of the wall material to be formed is thus reduced. There is also the advantage that the upper punch can be formed in a more stable manner. Without the above-mentioned function of the tool according to the present invention, the upper punch would have to be formed in such a way that it has a thin-walled and long extension, which, in the cavity between the support bodies, moves the volume elements of the upset wall height x along the stationary support body and into the die cavity. Such a thin-walled and long part of the upper punch may break under high forming forces with no guide element and therefore may make it impossible to carry out forming by the method according to the present invention.

The structural composition of the structure produced and possibly the stability of the structure can also be influenced positively depending on the material and processing parameters.

In a further advantageous development of the method according to the present invention, to carry out the forming process, the upper punch is held in a stationary manner, in particular relative to the upper edge of the preform, and the lower punch is moved with the base part of the preform so that the preform is pressed against the upper punch. A simplified tool design is thus enabled, since the upper punch can additionally be used to close the die cavity. Furthermore, the support bodies are advantageously to be introduced into the preform from above, at least in part, without additionally having to be moved in relation to the base of the preform during the forming process.

In a further embodiment of the method according to the present invention, to carry out the forming process, the lower punch is held in a stationary manner and the upper punch, preferably in the form of a thrust ring, is moved. The preform is pressed against the lower punch.

Forming by means of a thrust ring moved from above or by means of another type of upper punch affords the advantage that the volume elements of the wall of the preform can pass by inner wall support bodies and outer wall support bodies and, in this way, structures for example can be formed on both the inner and outer surface of the peripheral wall. Of course, the use of a movable upper punch is also conceivable without formation of double-sided structures.

In a further possible development of the method, the die cavity is moved during the forming process in relation to a movement of an upper edge of the wall of the preform being formed.

The die cavity also being moved in relation to the upper edge of the preform being formed affords the advantage that the material volume elements of the wall flowing into the die cavity and forming the structure only have to cover short flow paths. Material flows from both sides into the die cavity, whereby the structure is formed in a more uniform manner.

In a further expedient development of the method according to the present invention, the volume of the die cavity is increased during the forming process, and the height of the die cavity, which determines the height of the structure to be formed, is preferably increased.

An increase in the die cavity during the forming process makes it possible to form larger structures, since the wall thickness of the preform being formed present in the region of the cavity to be filled is always used for the effect of the buckling. If a die cavity of small cavity height is initially used, relatively small or thin wall thicknesses of the preform can thus also be selected. Whilst the wall thickness thickens in the region of the cavity during the forming process, the cavity height can also be increased accordingly, since the tendency for buckling is reduced by the wall thickness formed. Structures having a height b and an initial wall thickness t1 of the preform can thus be formed, in which the ratio b to t1 preferably only has to be less than 10. In principle, however, other ratios of structure height to initial wall thickness are also conceivable, and therefore greater ratios can also be achieved where necessary.

The tool in accordance with the present invention, comprises a receiving compartment having a height and a thickness to completely receive a preform having a wall height x and a radially measured wall thickness t1. The preform, which is inserted into the tool in the form of a beaker or in the form of a cup, is surrounded completely by the tool. Furthermore, the tool comprises at least one inner wall support body to support an inner wall or at least part of the inner wall surface of the preform. Furthermore, the tool comprises at least one outer wall support body to support an outer wall or at least part of an outer wall surface of the preform, and at least one die cavity formed as an extension of the receiving compartment and having a die cavity height extending parallel to the height of the receiving compartment and into which the material displaced by a forming process is introduced. The tool further comprises at least one upper punch and at least one lower punch to exert a forming force to carry out a forming process by reducing the height of the receiving compartment and, as a result, by displacing wall material of the preform into the die cavity. The basic process of lateral extrusion or upsetting of a preform is known from the prior art.

In accordance with the present invention, the tool is characterized in that, at least at the start of the forming process when the tool is closed, the ratio of the height of the receiving compartment or of the wall height x of the preform to the wall thickness t1 of the inserted preform is greater than 2.3.

The thickness of the receiving compartment of the tool basically corresponds to the wall thickness t1 of the preform. The reference to the wall thickness of the preform is significant for the dimensioning of the tool according to the invention however, since the risk of buckling during the forming process depends on the wall thickness of the preform. Due to a corresponding dimensioning of the die cavity, of the wall support body, and of the preform, components can be produced in a tool according to the present invention which could only be produced by the method of the prior art by means of lateral extrusion or upsetting with acceptance of buckling of the wall of the preform, which results in components that cannot be used.

In a development of the tool according to the present invention, the ratio of the die cavity height at the start of the forming process to the wall thickness t1 of the inserted preform is less than 10, preferably less than 5 and in particular less than 2.3.

In this parameter range, an improved structure formation is achieved and is produced without material buckling during the forming process.

In a development according to the present invention of the tool, this tool comprises a die in which the die cavity is formed. The die can be formed in particular by the inner wall support body and/or by the outer wall support body, or, alternatively or additionally, can be formed by a separate die body, at least in part, which can be inserted into a region of the tool.

Tool component parts to be produced in a cost effective and simple manner may thus either comprise the die cavities simultaneously, or increased versatility, by exchangeable die bodies, which may in turn contain movable parts, is provided.

The invention also relates to a mechanical component produced by forming, in particular by lateral extrusion or upsetting, wherein the component has a support and a structure surrounding the support surface, at least in part, wherein the structure has been produced by an upsetting process or lateral extrusion process of a wall of a preform produced from sheet metal, starting from the shape of the preform, wherein the upset wall had a height of more than 2.3 times its wall thickness before the upsetting process.

In one embodiment, at least 50% of the material volume of the wall of the preform, for example, is formed into the structure.

It is only possible to form thin-walled, tall preforms of this type, that is to say to carry out considerable material transport from a high wall region of a preform into a structure region of a component part, without the formation of undulations, folds and overlaps if buckling in the wall region is avoided during the upsetting process, for example, as with the method according to the present invention.

Further features and expedient embodiments of the tool according to the invention and of method steps of the method according to the invention will be illustrated in the following exemplary embodiments and, in particular, in the figures. The invention is not limited to the illustrated exemplary embodiments, however. Rather, it includes all the embodiments and methods which make use of the concept according to the invention.

DETAILED DESCRIPTION OF THE INVENTION

The figures will be explained in greater detail hereinafter. Recurring components in individual illustrations shown in different method states according to the invention during operation of an installation or forming installation are of course to be considered as being denoted for all illustrated figures, without this being stated explicitly for each individual illustration. Within the context of the present invention, an installation is to be understood to mean a forming device in which the tool according to the present invention is used and which carries out the method according to the present invention. The mechanical means used to carry out the method are not relevant to the consideration of the present invention.

Figure 1:
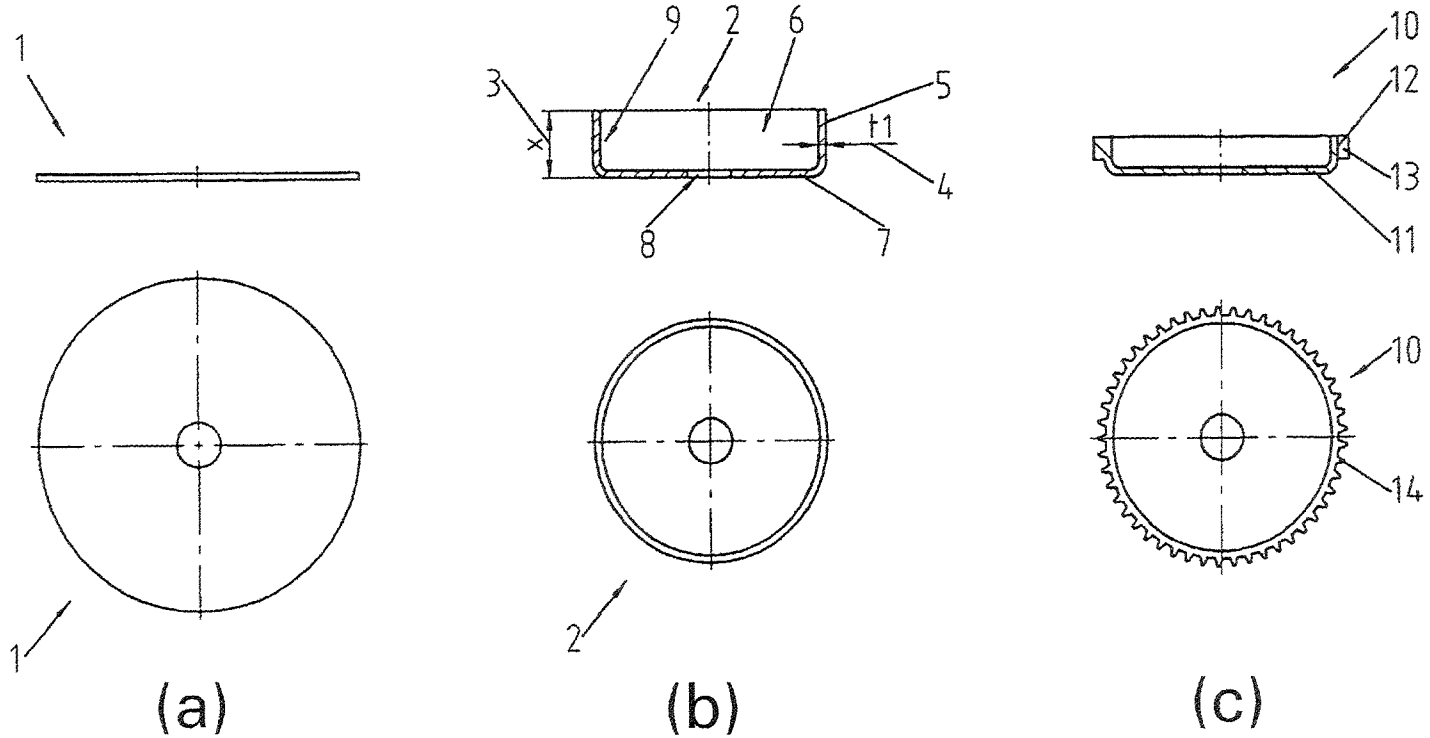
FIGS. 1(*a*)-(*c*) show exemplary schematic illustrations of a planar blank, a preform, and a finished component part.

Specifically, FIG. 1(*a*) shows a planar blank 1, preferably formed from a sheet metal, which is formed into a preform 2, which is then introduced into the method according to the present invention. The illustrations according to FIGS. 1(*a*)-(*c*) are shown in sectional view and in plan view in each case.

FIG. 1(*b*) shows the preform 2 produced from the planar blank 1 and which, as a thin-walled preform 2, has a cup shape 6 with a wall height x 3, of which the wall thickness t1 4 corresponds to the wall 5 in approximately one wall thickness of the planar blank 1. The cup shape 6 is closed on its underside by a base part 7, which preferably has an opening 8 in its center.

If a segment section of FIG. 1(*b*) is considered as a segment of a circle, this is L-shaped when viewed in half. In cross section, FIG. 1(*b*) shows a U-shaped cross-sectional symmetry 9 on the whole.

FIG. 1(*c*) shows a sectional view and a plan view of a finished component part 10, which comprises a support 11, over the outer surface or support surface 12 of which a structure 13, for example in the form of teeth 14 of a gearwheel, applied by forming or lateral extrusion or upsetting has been formed.

It is also conceivable, however, for the structure to be formed, for example, merely as a peripheral thickening, which can preferably be reworked in a subsequent processing step by milling or the like to form a tooth shape.

Figure 2:
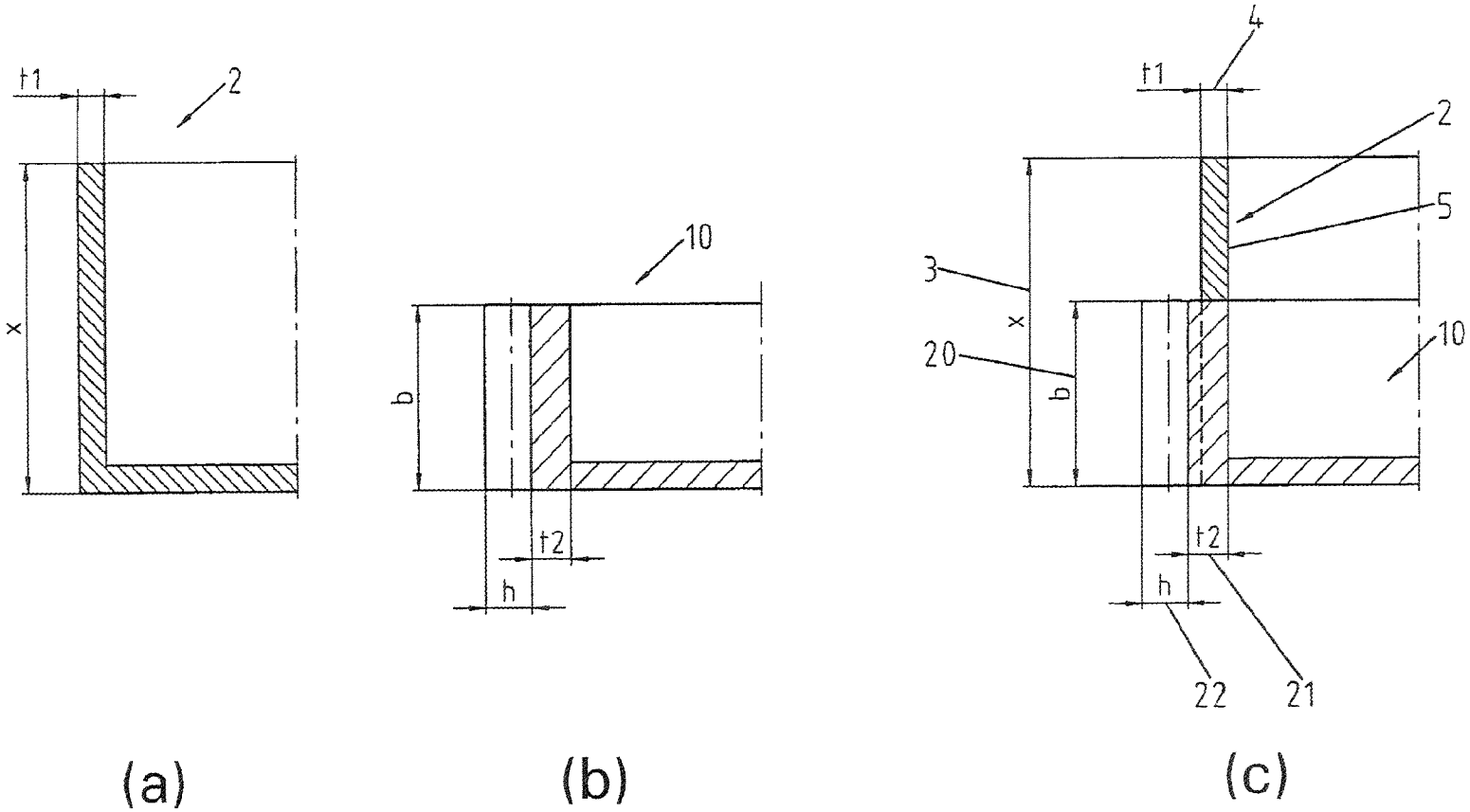
FIGS. 2(*a*)-(*c*) show a section through a wall region of the preform and of the finished component part.

FIG. 2(*c*) shows a more detailed illustration of half of the preform 2 in a cup shape 6 in sectional view, wherein the wall 5 of the cup shape 6 of the preform 2 has an initial wall thickness t1 4 and an initial wall height x 3. The larger hatched region of FIG. 2(*c*) illustrates a half sectional view, which shows the finished formed component 10 with a height b 20 and a wall thickness t2 21. In addition to the thickened wall as a first applied structure component, which has been applied to an intended support surface 12 to achieve the wall thickness t2, FIG. 2(*c*) also shows an additional material upset in another region to obtain a second structure component—a toothing having a tooth height h 22. Material accumulations of this type are provided in the method according to the present invention, wherein, compared to the wall thickness t1 4 of the preform, a wall thickness t2 21 of the component remaining equal or increasing compared at least to the initial wall thickness t1 4 is always provided.

FIGS. 2(*a*) and (*b*) show the respective individual parts of the projection from FIG. 2(*c*). FIG. 2(*a*) shows a segment of the preform 2, and FIG. 2(*b*) shows a segment of the component 10.

Figure 3:
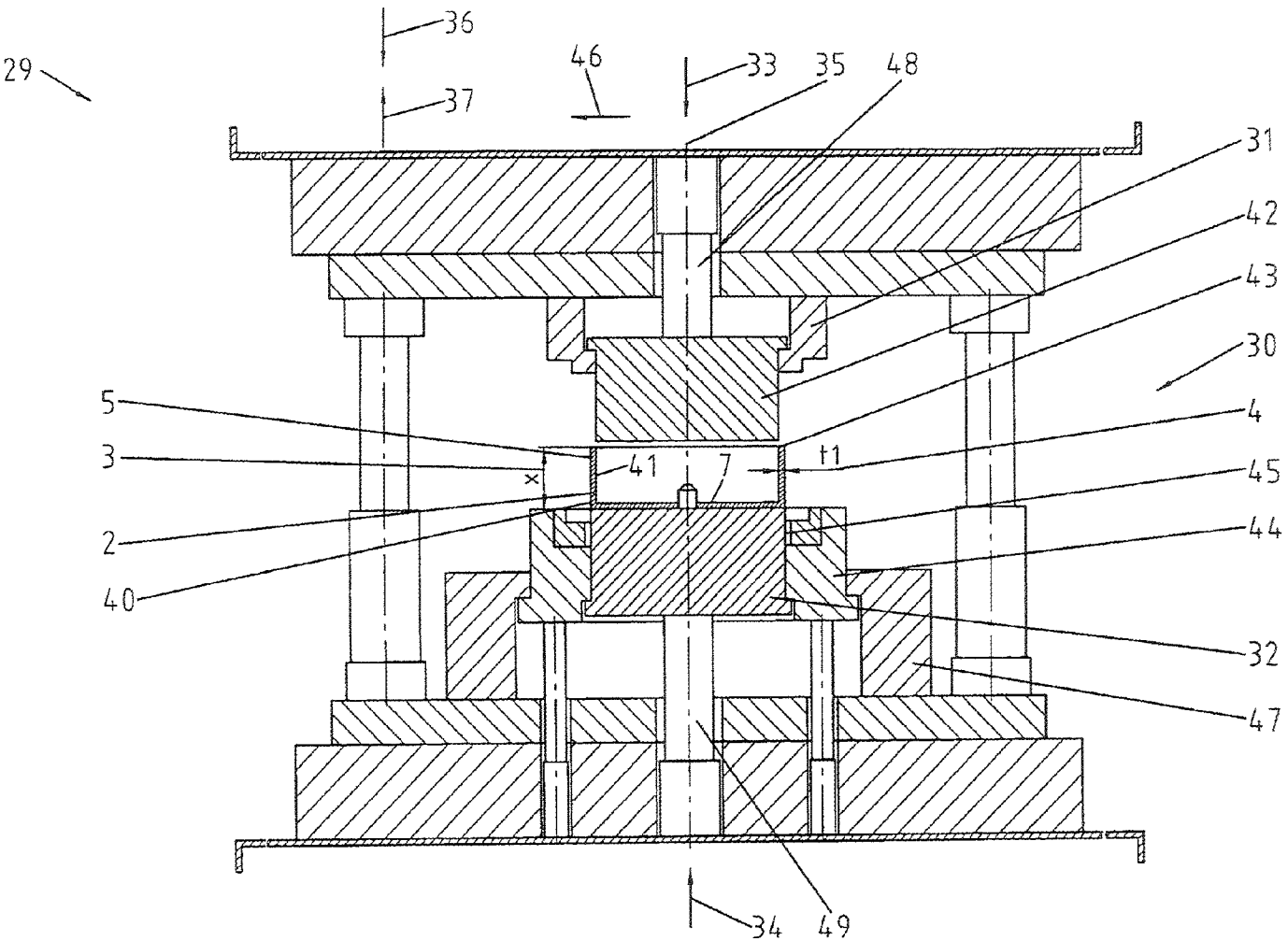
FIG. 3 shows a schematic illustration of a forming installation with the tool according to the invention.

FIG. 3 shows an exemplary view of an arrangement of a tool 30 according to the invention in a forming installation 29 in the state of the first method step according to the present invention. In this case, the tool 30 comprises an upper punch 31 and a lower punch 32, wherein these are designed to exert an upper forming force 33 and a lower forming force 34. The installation 29 is symmetrical about an axis of symmetry 35 and is illustrated in section in the present case. During operation of the installation 29, the upper punch 31 can move in the downwards direction of movement 36. The lower punch 32 likewise moves in the downwards direction of movement 36 over the course of the method according to the present invention. To return the installation 29 to the corresponding starting positions, the movements in the downwards direction 36 are reversed in upwards directions 37.

The preform 2 having the wall thickness t1 4 of the wall 5 and a first wall height x 3 is inserted into the working range of the tool 30. The preform 2 has an outer wall surface 40 and an inner wall surface 41 for forming the cup shape 6. An inner wall support body 42, which is arranged above the upper edge of the wall 43 whilst the preform 2 is inserted into the tool 30, is located in the upper region of the tool. The tool 30 also comprises an outer wall support body 44, which is arranged in the lower region of the tool. The die cavity 45, which, in the radial direction 46 starting from the axis of symmetry 35, forms a receiving region for the upsetting process taking place subsequently for the displaced material, whereby the desired structure of the component can be formed, is located above the outer wall support body 44.

The tool 30 further comprises a stop 47 for the upward movement of the outer wall support body, the stop being arranged in the lower region.

The inner wall support body 42 is provided from above with a pressure piston 48, which provides a defined compressive force for the inner wall support body. The lower punch 32 is accordingly likewise provided with a lower pressure piston 49, which provides a lower compressive force which counteracts the upper compressive force of the piston 48, but which is weaker however.

Over the course of the second method step according to the invention (not illustrated), the inner wall support body 42 is advanced into the cup shape 6 of the preform 2. It then presses against the base surface 7 with the compressive force of the upper pressure piston 48 and shifts the preform 2, together with the lower punch 32, against the compressive force of the lower piston 49 and downwards into the tool. The forces are therefore set in such a way that the force provided by the upper piston 48 is at least slightly greater than the force countered by the lower piston 49. The sequence of movements is reversed during the subsequent opening of the tool according to the invention to remove the component.

Figure 4:
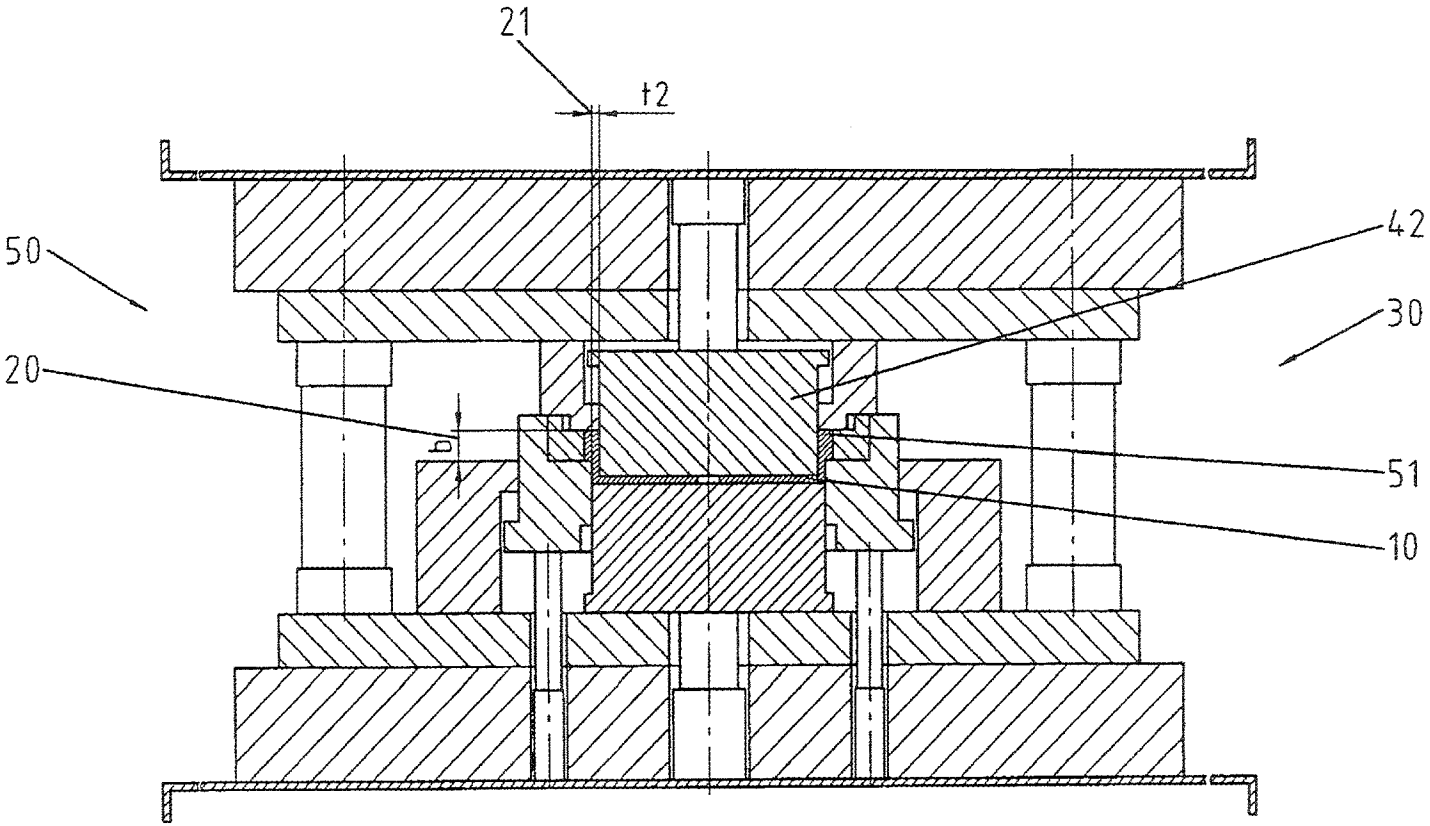
FIG. 4 shows a further state of the installation according to FIG. 3 when the method according to the invention is being carried out.

FIG. 4 shows an illustration of the installation 29 according to FIG. 3 in the third method step, wherein the process of forming the preform 2 into the desired component 10 has been carried out.

FIG. 4 shows that the preform 2 has now been formed into the component 10, which has the radially measured wall thickness t2 21 beneath the applied structure and has been formed into a second, smaller height b 20 as a result of the upsetting process 50. The position of the inner wall support body 42 relative to the base surface 7 of the preform 2 has not changed during the upsetting process 50. To carry out the upsetting process 50, the lower punch 32 with the preform 2 located thereon was lowered, whereby the preform was introduced along the downwards direction of movement 36 into the region between the outer wall support body 44 for supporting the outer wall surface 40 and the inner wall support body 42. By lowering the upper punch with the inner wall support body 42 adjacent thereto, the latter in the inner region of the preform 2 to support the inner wall surface 41, the tool was closed so that the upsetting process 50 to form the preform 2 into the component 10 could be carried out by the upper punch. In this case, the die cavity 45 is filled by displaced material of the wall 5 of the preform 2 so that the structure 51 is produced. The position of the outer wall support body 44 changes relative to the position of the base surface, because material from the wall 5 of the preform 2 is displaced from this region into the die cavity 45.

Figure 5:
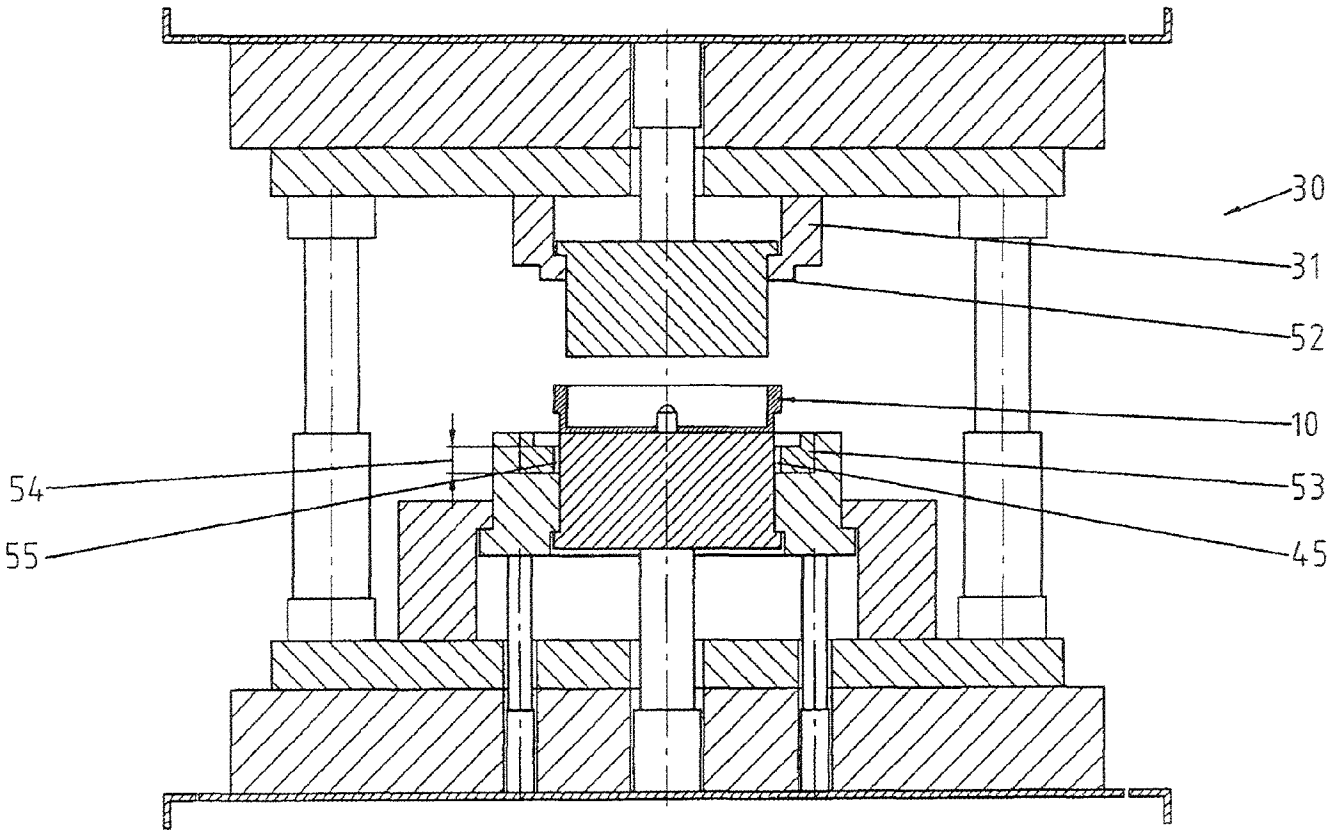
FIG. 5 shows a further state of the installation according to FIG. 3 when the method according to the invention is being carried out.

FIG. 5 shows the installation with the tool 30 according to the present invention during the removal process of the component part 10. With the upper punch 31 retracted, the upper punch having a thrust ring 52 at its lower end, and the inner wall support body 42 thus likewise removed and the component 10 ejected by the lower punch 32, the die cavity 45 in the die body 53 is released again. The height of the die cavity 54 corresponds to the height of the structure produced on the finished component 10, just as the volume of the die cavity 55 corresponds substantially to the volume of the structure on the component part 10.

Figure 6:
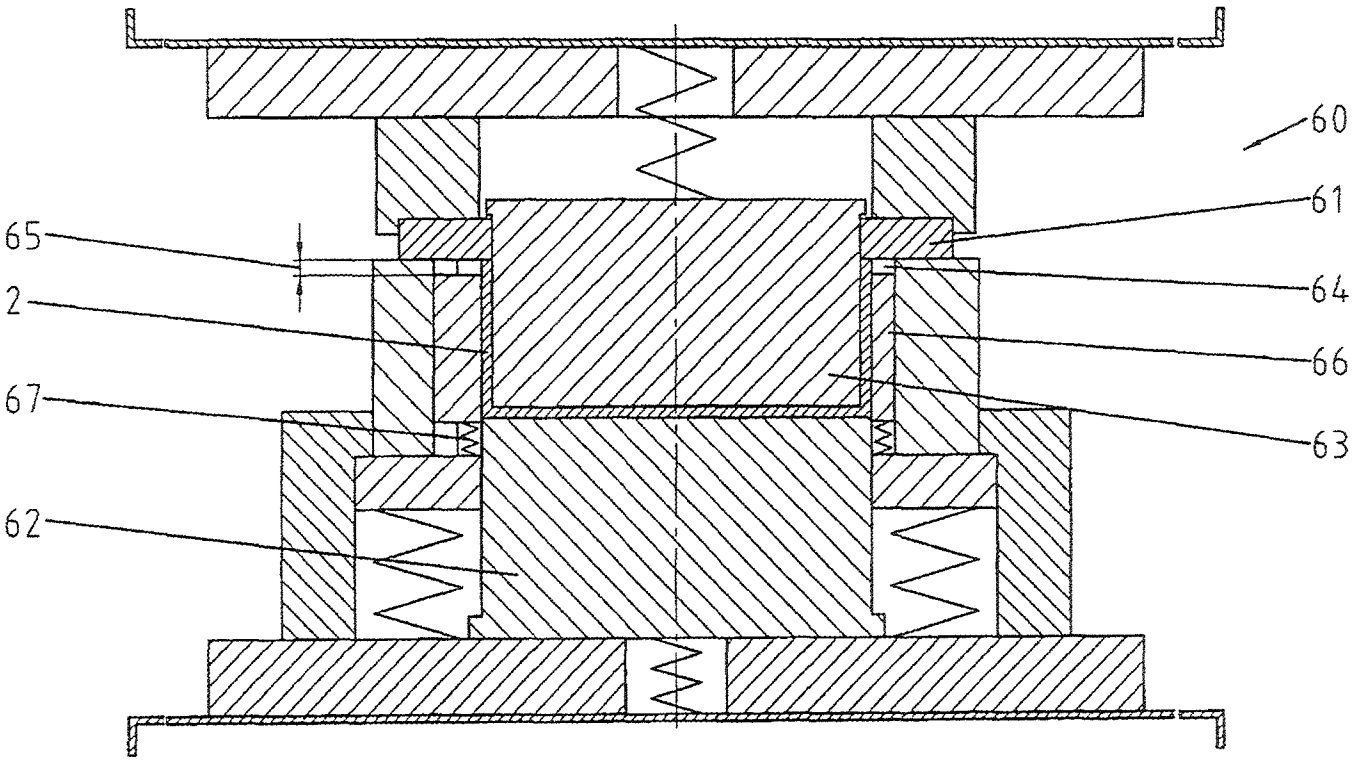
FIG. 6 shows a forming installation with a tool according to the invention, which provides a variable cavity height.

FIG. 6 shows a further schematic illustration of an installation for carrying out the method according to the invention by means of a tool 60 according to the present invention, wherein, in this installation, adaptations are made to provide a die cavity 64 which is flexible in terms of volume. With regard to equivalent, comparable denoted parts, reference is made to FIGS. 3 to 5, wherein details have been changed in the present exemplary embodiment.

The embodiment according to FIG. 6 shows a tool 60, which comprises an upper punch 61 and a lower punch 62. In the present illustration, the inner wall support body 63 has already been advanced into the preform 2, and the tool 60 has been closed. In the closed state, the tool 60 has a die cavity 64, wherein, in the present illustration, the size of the cavity is illustrated for example in the region of the structure of a tooth on the left-hand side, and the size of the cavity is illustrated in the region of a gap between teeth on the right-hand side and is therefore smaller. The die cavity 64 has an initial height 65, which has been selected to be so small that buckling of the wall 5 of the preform 2 during the onset of the upsetting process of the wall 5 of the preform 2 is prevented. An outer wall support body 66 is illustrated beneath the die cavity 64 in the present case and is held at its underside by a spring ballast 67.

It should be noted with regard to this figure and the following figures that the denotation of a respective spring ballast is symbolic of different actuators exerting a force or counterforce, and therefore pressure cylinders or other defined or controllable force generators or moving devices can also be used alternatively by all means. Spring ballasts are illustrated in the figures for reasons of schematic clarity.

Figure 7:
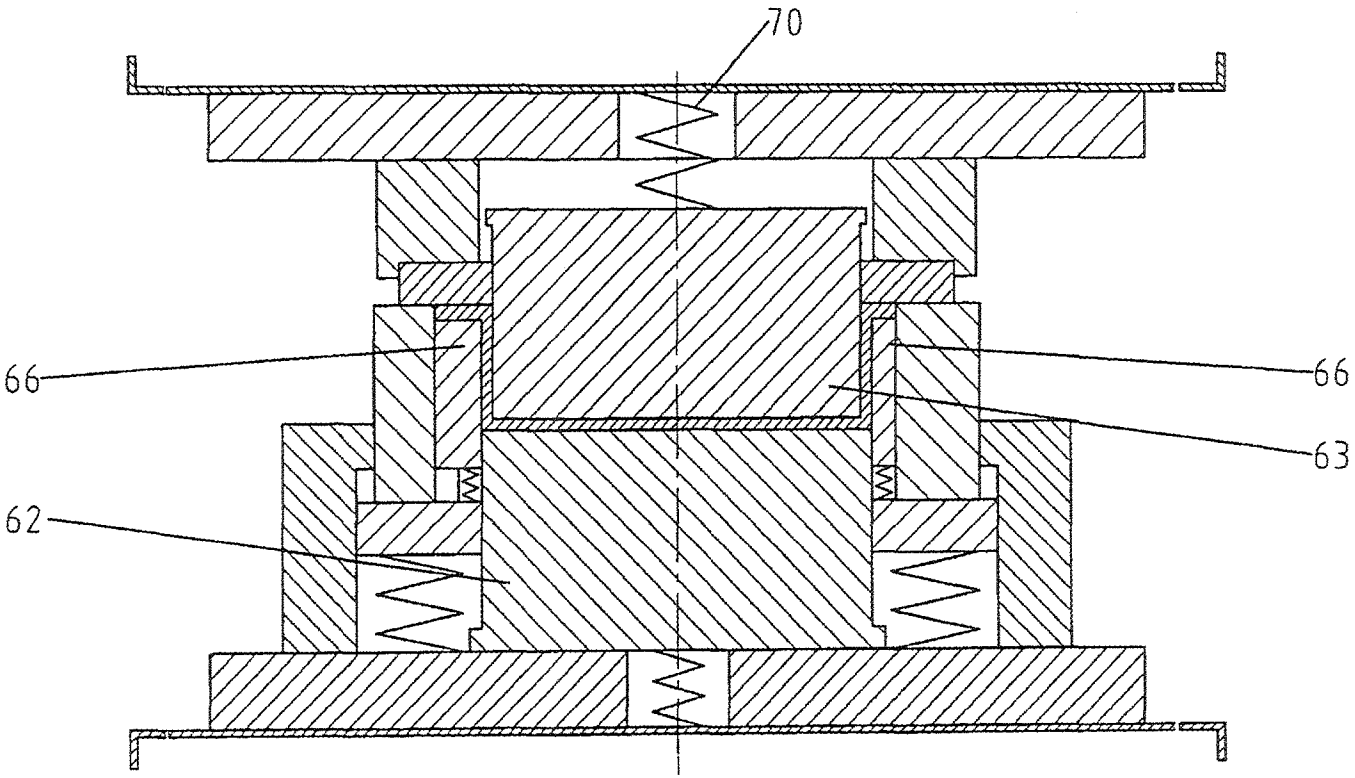
FIG. 7 shows a further state in the method according to the invention of a forming installation according to FIG. 6.

FIG. 7 shows an illustration according to FIG. 6, wherein the upsetting process has been begun in the present case by moving the upper punch 61 downwards. The inner wall support body 63 travels into the upper punch 61, against a spring ballast 70 arranged above, so that a volume component of the preform 2 has been introduced into the die cavity 64 by means of lateral extrusion or upsetting. The outer wall support body 66 is located in this case in the same state as in the position according to FIG. 6, and therefore only the initial height of the die cavity 65 is so far filled with material.

Figure 8:
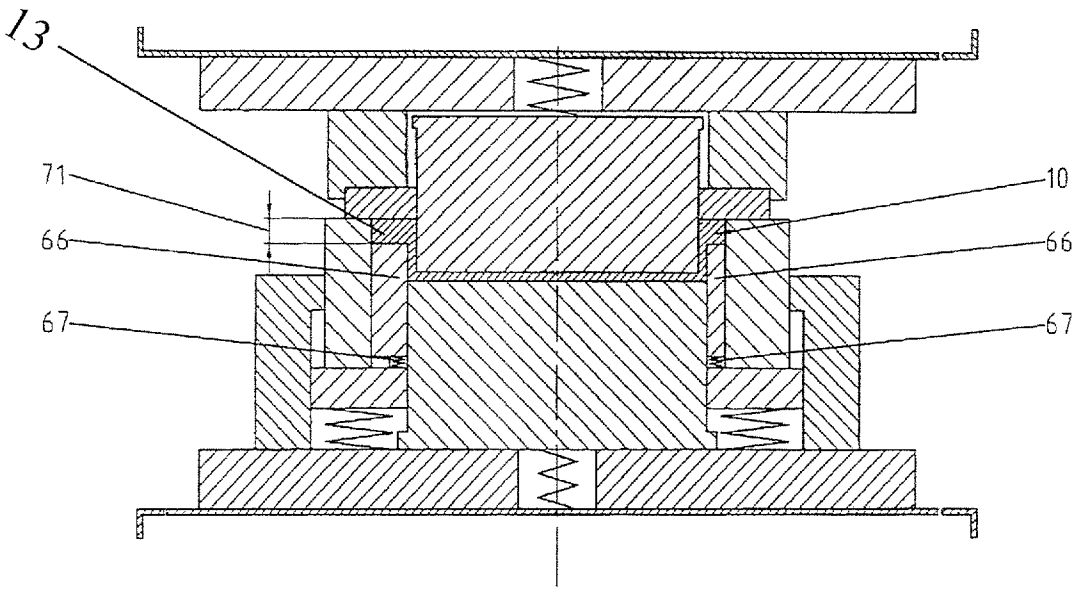
FIG. 8 shows a further state in the method according to the invention of a forming installation according to FIG. 6.

FIG. 8 shows a further state of the installation according to FIGS. 6 and 7, wherein, in the present state, the outer wall support body 66 has been displaced downwards against the spring ballast 67 by additional displacement of material of the preform 2 by the upsetting process carried out, whereby the height of the die cavity 71 has grown to the end height of the structure of the component to be produced. It has thus been possible to achieve a relatively large end height of the die cavity 71 compared to the initial wall thickness t1 for production of a structure 13 (for example, of teeth on a gearwheel on a component 10) without the material buckling during lateral extrusion or upsetting.

Figure 9:
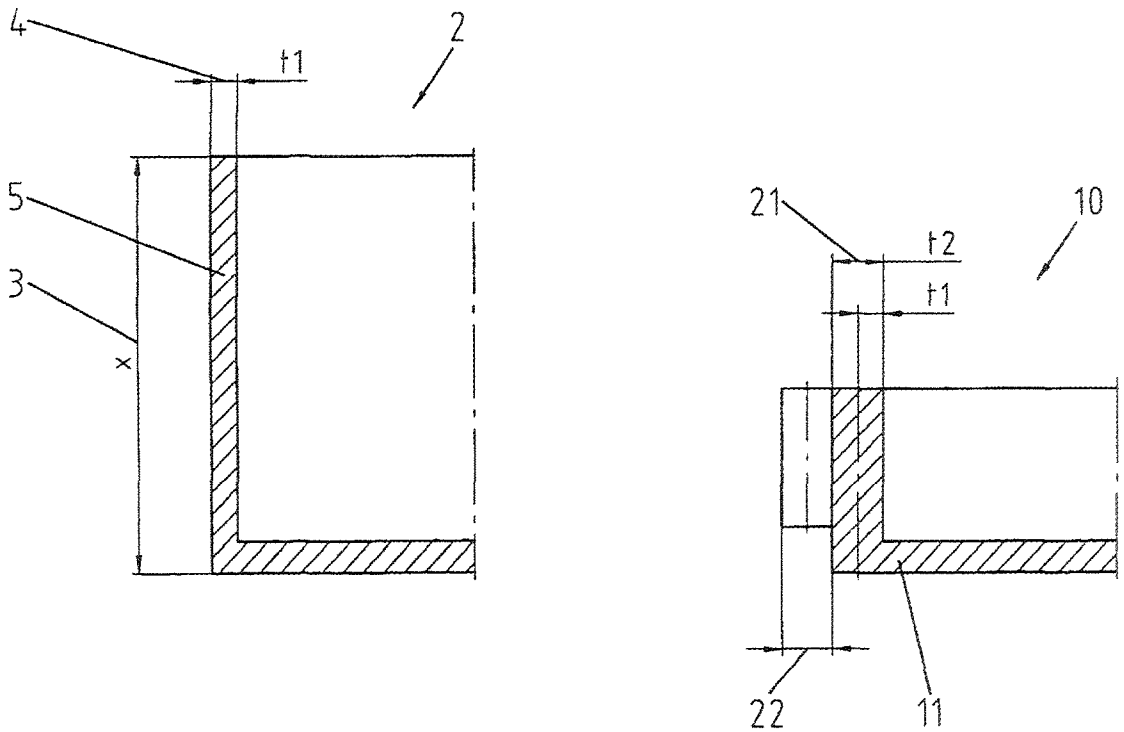
FIGS. 9(*a*) and (*b*) show illustrations of a segment section of a preform and of a component part.

FIG. 9(*a*) shows a further illustration of a segment section of a preform 2, which has an initial wall thickness t1 4. The material available to form a structure 13 within the scope of a forming process by lateral extrusion or upsetting from the wall 5 of the preform 2 corresponds to the material volume of the peripheral wall 5, formed by the initial wall height x 3 and the wall thickness t1 4.

The illustration in FIG. 9(*b*) shows, schematically, that a support 11 having the wall thickness t1 4, which corresponds to the sectional volume from the component 10 and the preform 2 projected thereinto, forms a base. Compared to the preform 2, a thickening of the wall to a wall thickness t2 21 has occurred as a component of the structure, and material volume has also additionally flowed in the form of a tooth height 22 as a further component of the structure. The entire formed material volume of the structure thus applied to the support, the structure being formed of the wall thickening and the tooth height, is thus to be obtained from the material of the wall 5 of the preform 2.

Figure 10:
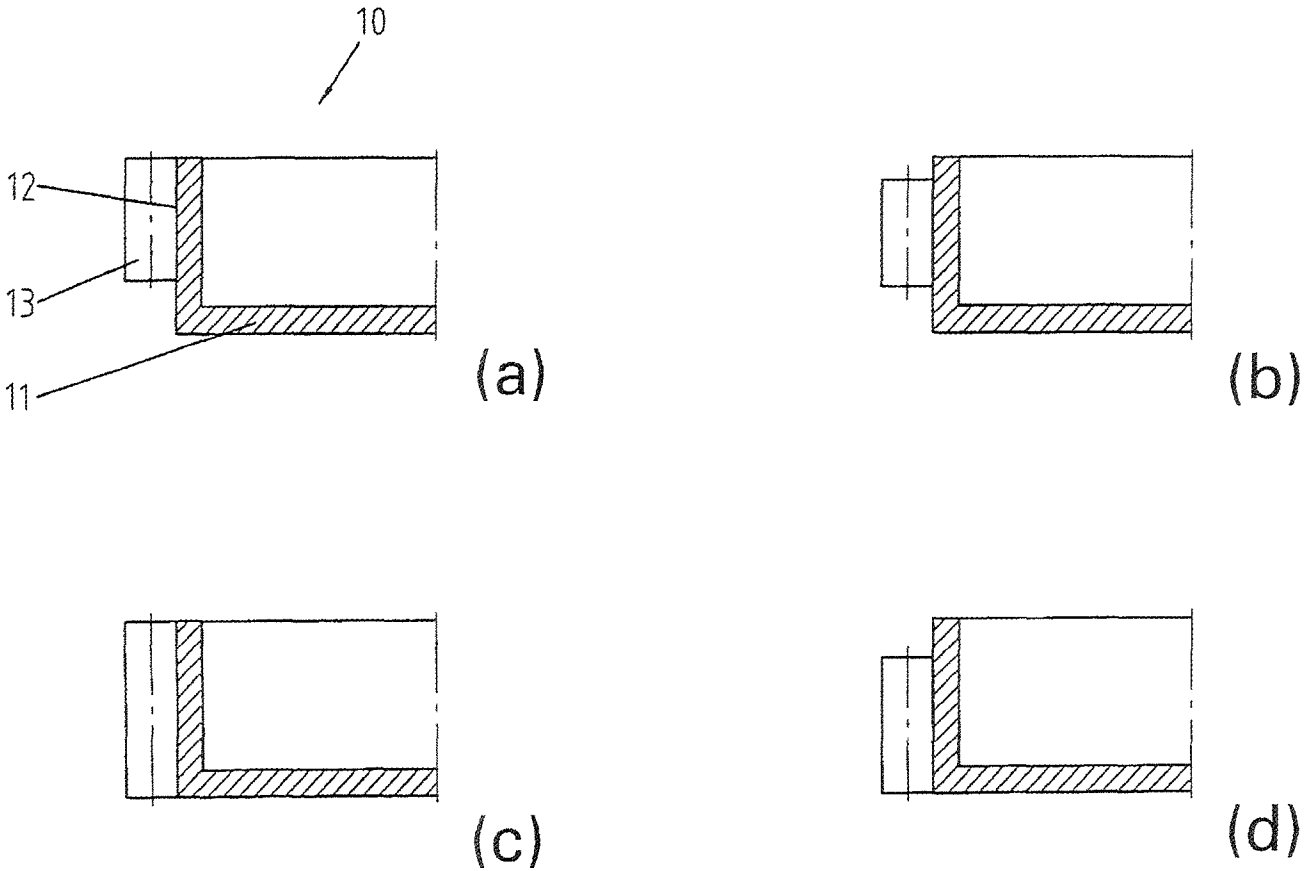
FIGS. 10(*a*)-(*d*) show different embodiments of the structure formed by means of the method according to the invention.

FIGS. 10(*a*) to (*d*) show variants of the different embodiments of the component parts 10, in which different structures 13 surrounding the support surface 12 have been applied to a support 11 on a support surface 12. In this case, it is conceivable, depending on the embodiment of the tool and of the die cavity, that the structure 13 ends either at the upper edge (a), is staggered both in the region of the upper edge of the support 11 and in the region of the lower edge of the support 11 (*b*), terminates together with the upper and lower edges of the support (c), or is staggered merely in the region of the upper edge of the support (d).

Figure 11:
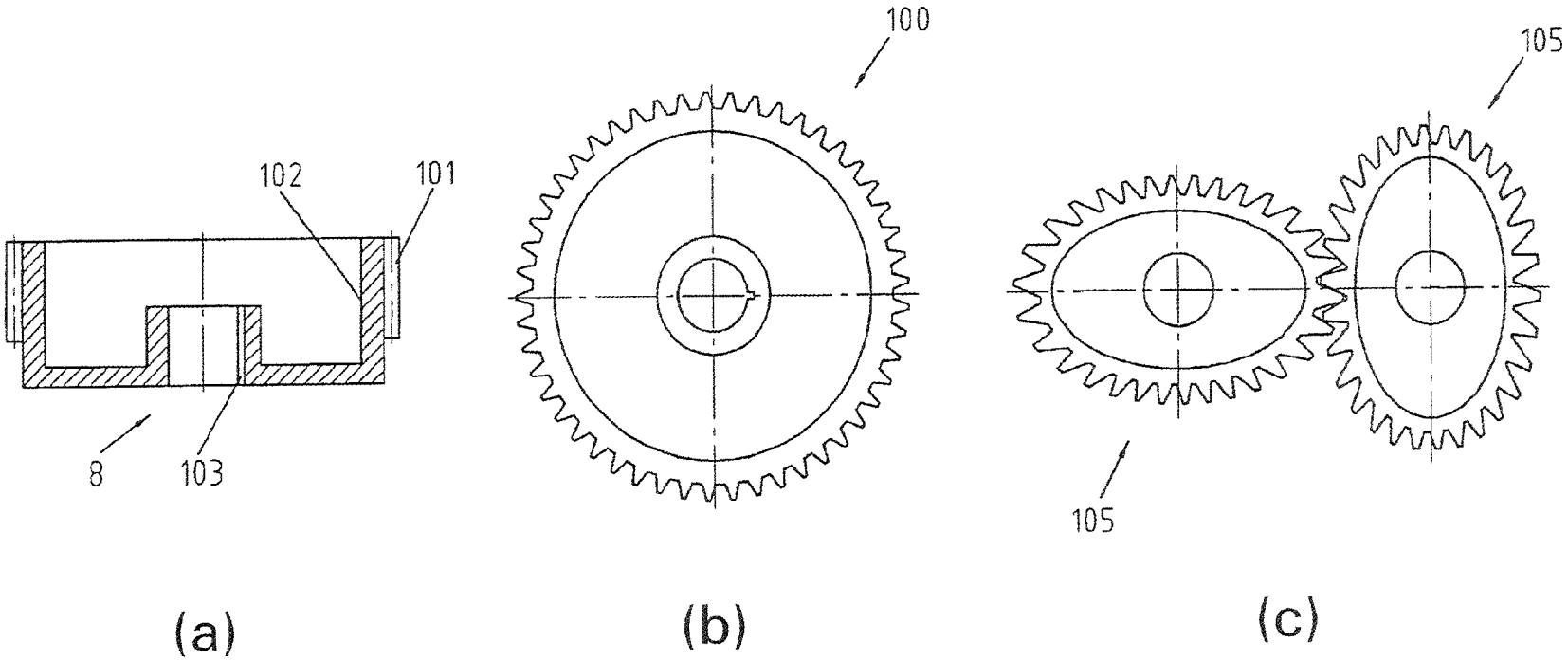
FIGS. 11(*a*)-(*c*) show different component embodiments.

FIGS. 11(*a*) and (*b*) show a possible embodiment of a component 100 which has been produced in accordance with the present invention. In addition to the simple version shown previously of application of merely one structure, for example of a toothing, to a cup-shaped preform 2, a further variation is illustrated in the present case in FIG. 11, for example, with the formation of a component 100 extended by a receiving region for a central shaft. In the present case, an outer toothing corresponding to the preceding examples is formed on the component 100. The outer toothing 101 has been formed flush with the upper edge of the wall 102 of the support. In the region of the opening 8, an additional wall construction has been provided, likewise by application of the method according to the invention, in which for example a groove for an adjusting spring 103 can be recessed. In order to provide such molded formations, the preform must have corresponding wall elements, which is possible in particular when produced by forming from a sheet metal.

FIG. 11(*b*) shows a plan view of the component part 100.

FIG. 11(*c*) shows an illustration of elliptically formed components 105, which, by means of the method according to the invention, can be produced on the basis of the advantage of the greatest level of versatility with regard to shaping. In addition to the elliptical component 105 illustrated in this case, any other geometries which can be produced from a corresponding preform of appropriate geometry are also conceivable.

Figure 12:
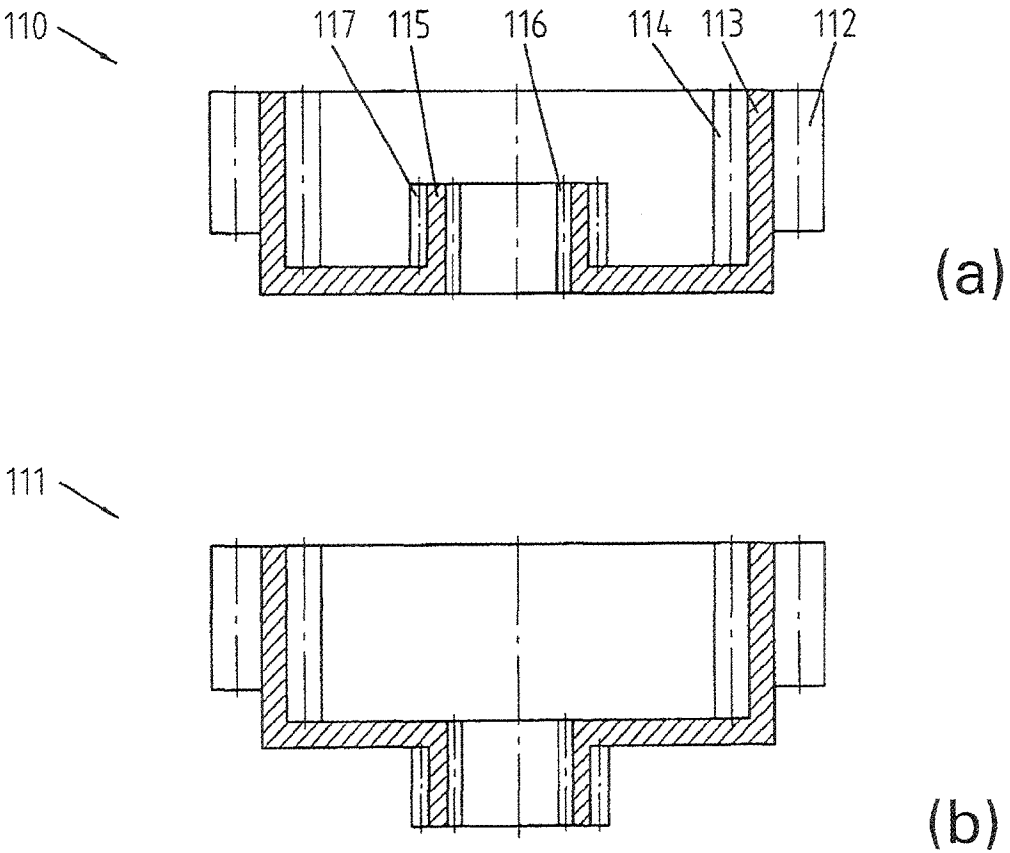
FIGS. 12(*a*) and (*b*) show further component embodiments.

FIGS. 12(*a*) and (*b*) show further embodiments of component parts 110 and 111, which can be produced via the method according to the invention. By way of example, FIG. 12(*a*) illustrates that an inner toothing 114 can also be adjoined to the component 110 in the region of an outer flange 113, in addition to the outer toothing 112. Furthermore, both an inner toothing 116 and an outer toothing 117 can be formed on an inner flange 115, wherein the material required to form the respective structure always has to be provided from the wall height of the preform provided. By way of example and in addition, a component is illustrated in FIG. 12(*b*), in which the inner flange exits downwards towards the underside, that is to say towards the outer face of the component, and likewise has corresponding toothings.

In accordance with the illustration from FIG. 9, the components of FIGS. 10 to 12 may also obtain additional structure components in the form of wall thickenings, besides formed structures, for example in the form of teeth, as a result of the method according to the present invention.

Figure 13:
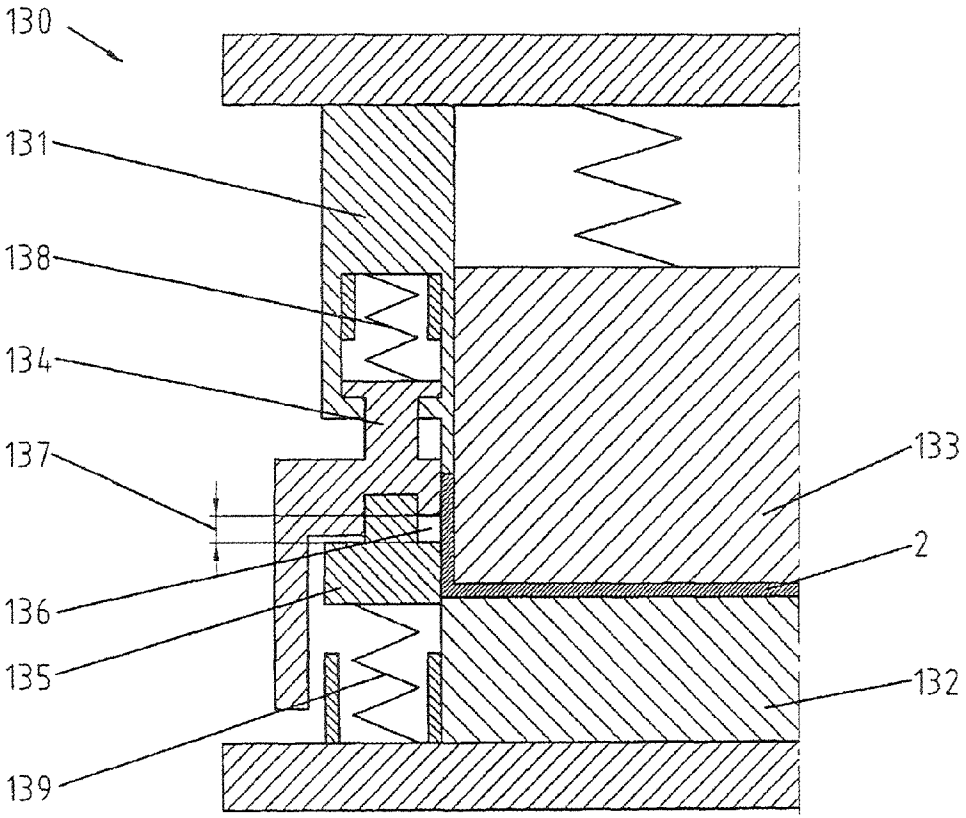
FIG. 13 shows a (half side) illustration of a tool according to the invention for providing a variable die cavity.

FIG. 13 shows a schematic partial illustration of an installation with use of a further embodiment of a tool according to the present invention. The tool 130 according to the invention likewise comprises an upper punch 131 and a lower punch 132, which are used to exert a forming force on a preform 2. In addition to the punches 131, 132, an inner wall support body 133 is provided, which, in the present exemplary embodiment, supports the entire surface of the inner wall of the preform 2. To provide corresponding structures, as have been described in FIGS. 11 and 12 above, the support bodies are to be adapted or different equivalent embodiments are to be used.

The present embodiment of the tool 130 according to FIG. 13 further comprises an arrangement of outer wall support bodies 134 and 135, which involves an upper outer wall support body 134 and a lower outer wall support body 135. A cavity 136 is formed between the regions of the outer wall support bodies 134 and 135 adjacent to the outer wall of the preform 2, the cavity being available as a die cavity to the wall material of the preform 2 during the forming process. The cavity 136 has an initial cavity height 137, which, in accordance with the method according to the present invention, is kept small in accordance with the buckling length to be considered. The upper outer wall support body 134 is supported with respect to the upper punch 131 by a spring ballast 138. The lower outer wall support body 135 is accordingly supported with respect to the lower punch 132 by a spring ballast 139.

Figure 14:
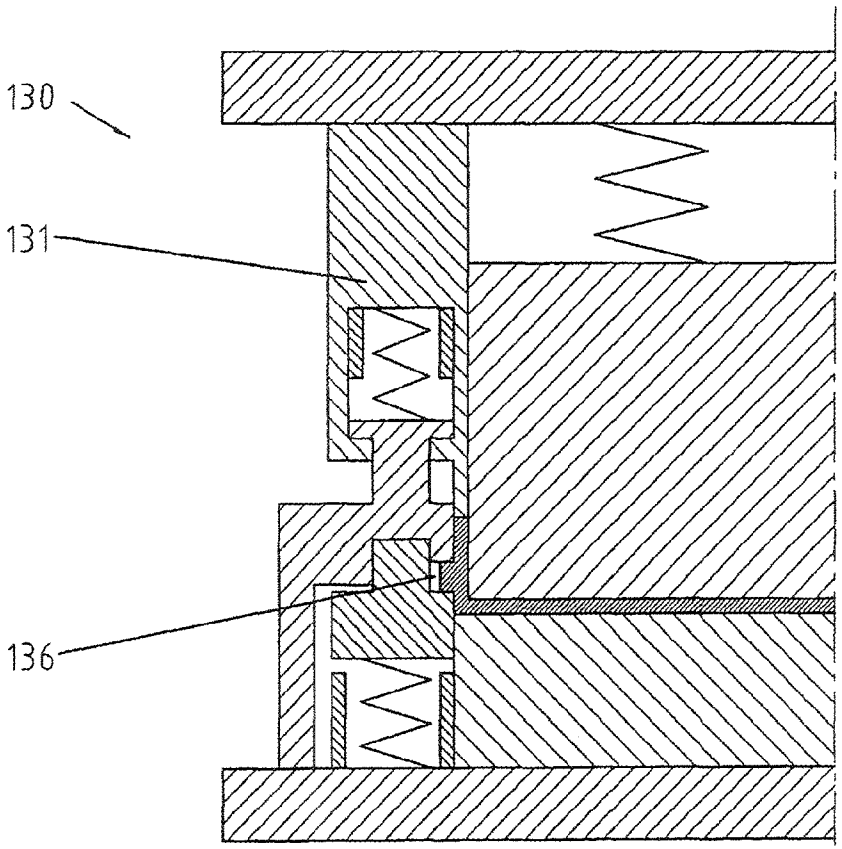
FIG. 14 shows a further state in the method according to the invention of a tool according to FIG. 13.

FIG. 14 shows the illustration of the installation according to FIG. 13, wherein, in FIG. 14, the forming process has been started by lowering the upper punch 131. A resultant force is exerted both on the upper outer wall support body 134 and on the lower outer wall support body 135 by material infiltrating the cavity 136, the force driving the support body against the respective spring ballast 138, 139. In the illustration according to FIG. 14, the upper outer wall support body 134 has not yet moved, whereas the lower outer wall support body 135 has already shifted downwards.

Figure 15:
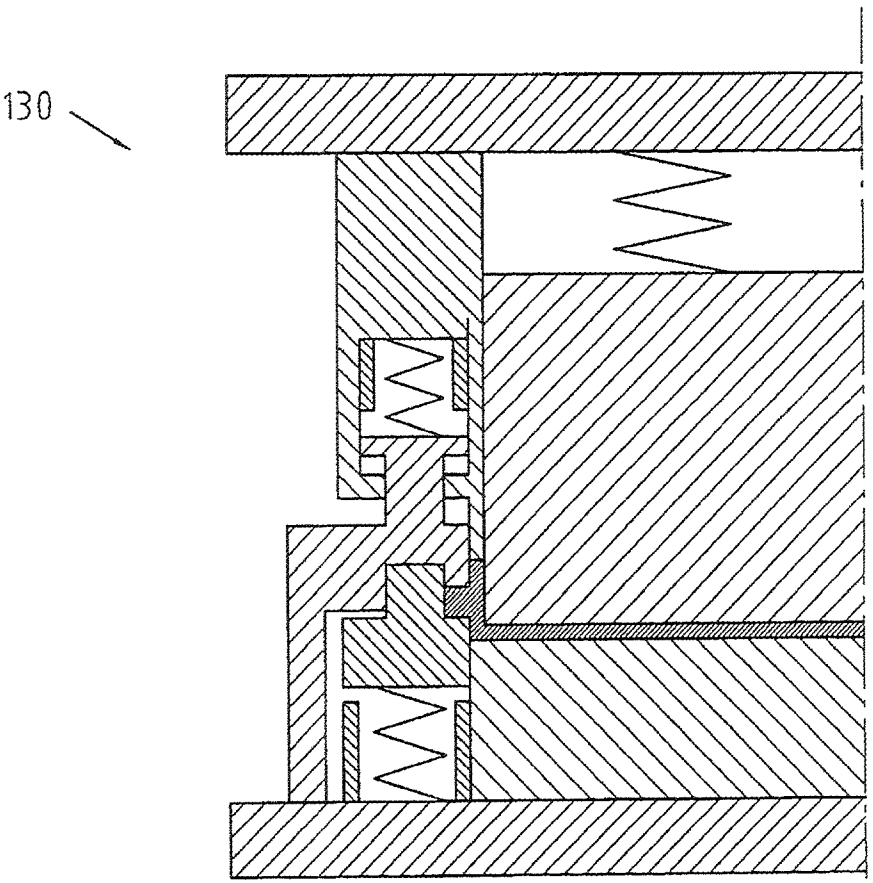
FIG. 15 shows a further state according to the invention of a tool according to FIG. 13.

A further illustration of the installation according to FIG. 13 is shown in FIG. 15, wherein, in the present case, both the upper outer wall support body 134 and the lower outer wall support body 135 have shifted against the respective spring ballast 138 and 139.

Figure 16:
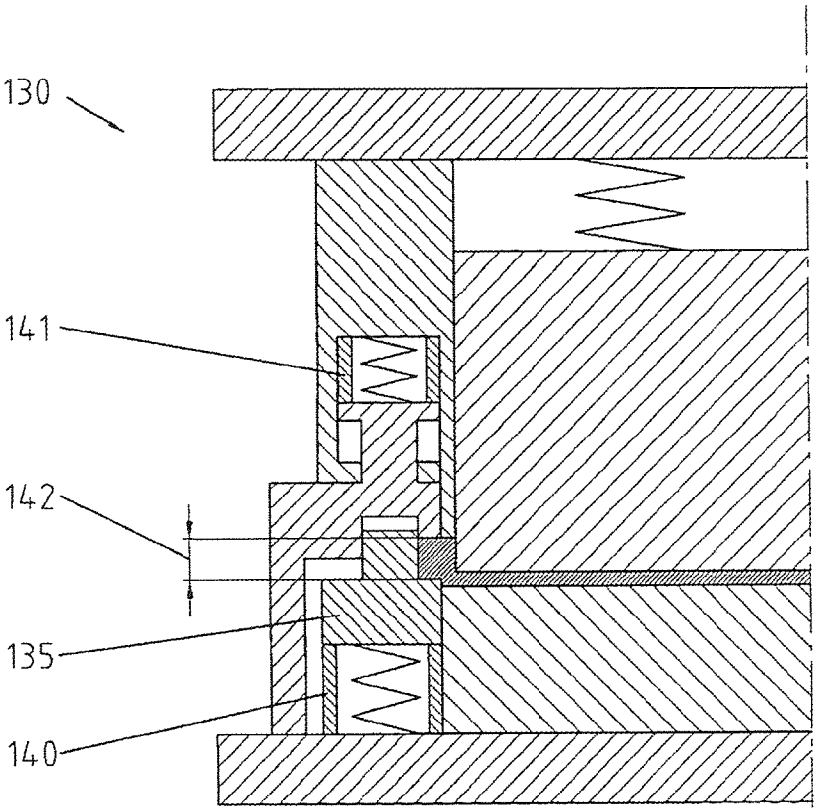
FIG. 16 shows a further state according to the invention of a tool according to FIG. 13.
Figure 17:
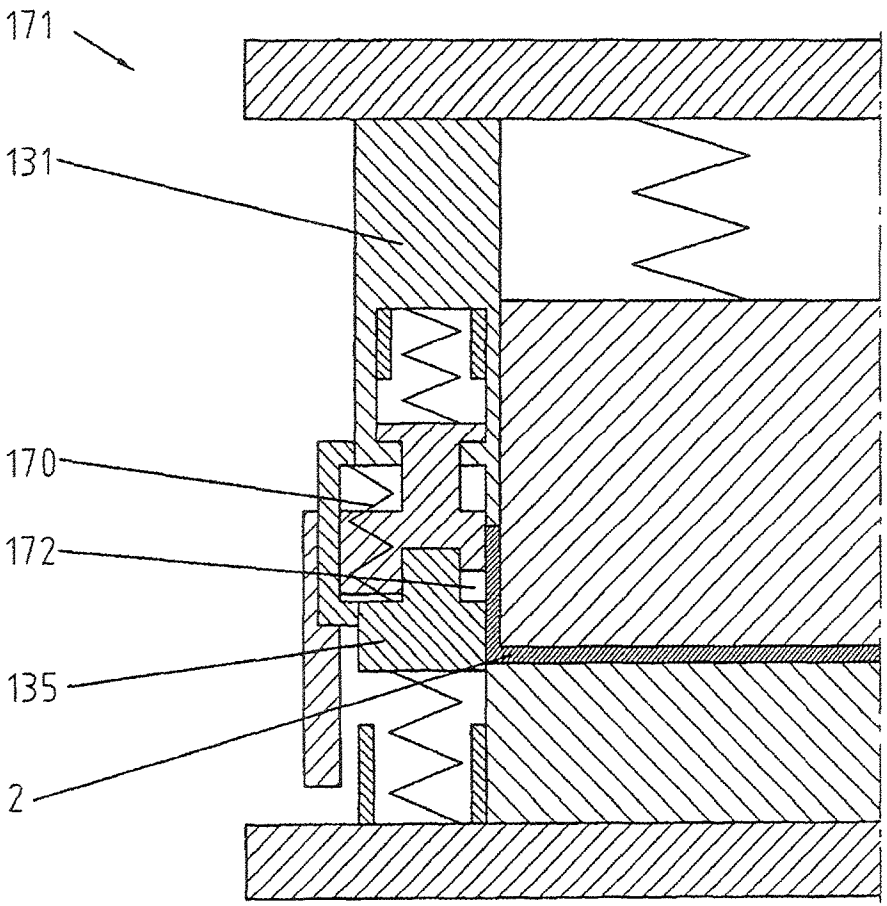
FIG. 17 shows a further embodiment by adding a further spring ballast to a tool according to FIG. 13.
Figure 18:
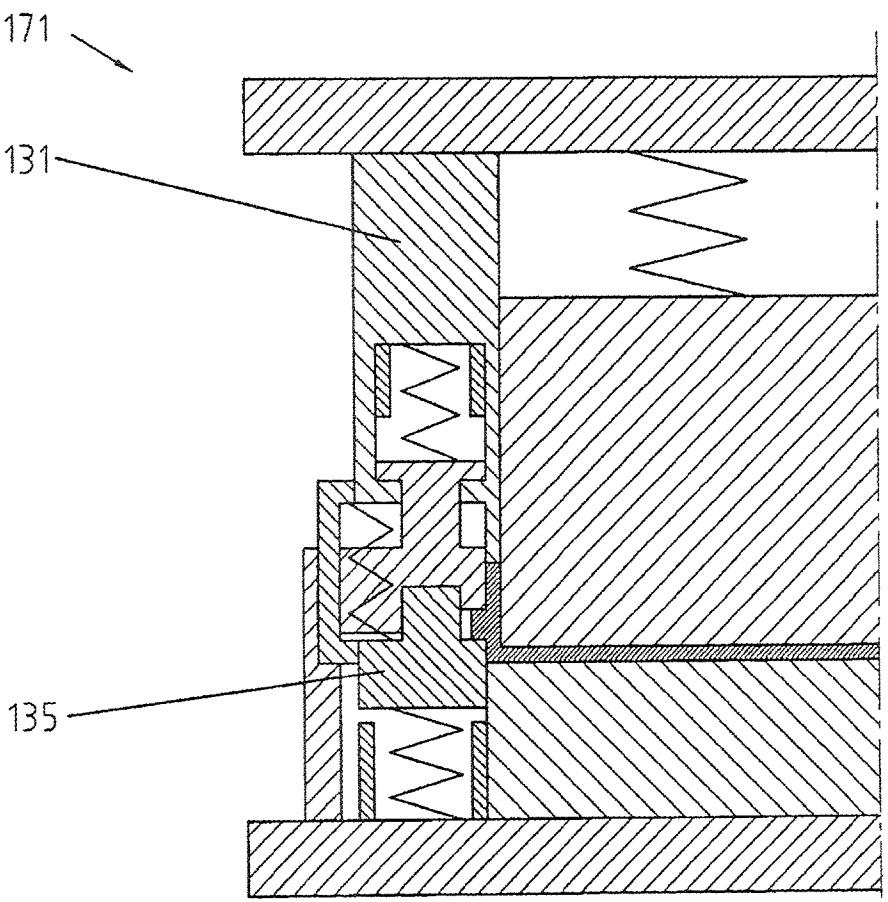
FIG. 18 shows a further state of the tool according to FIG. 17.
Figure 19:
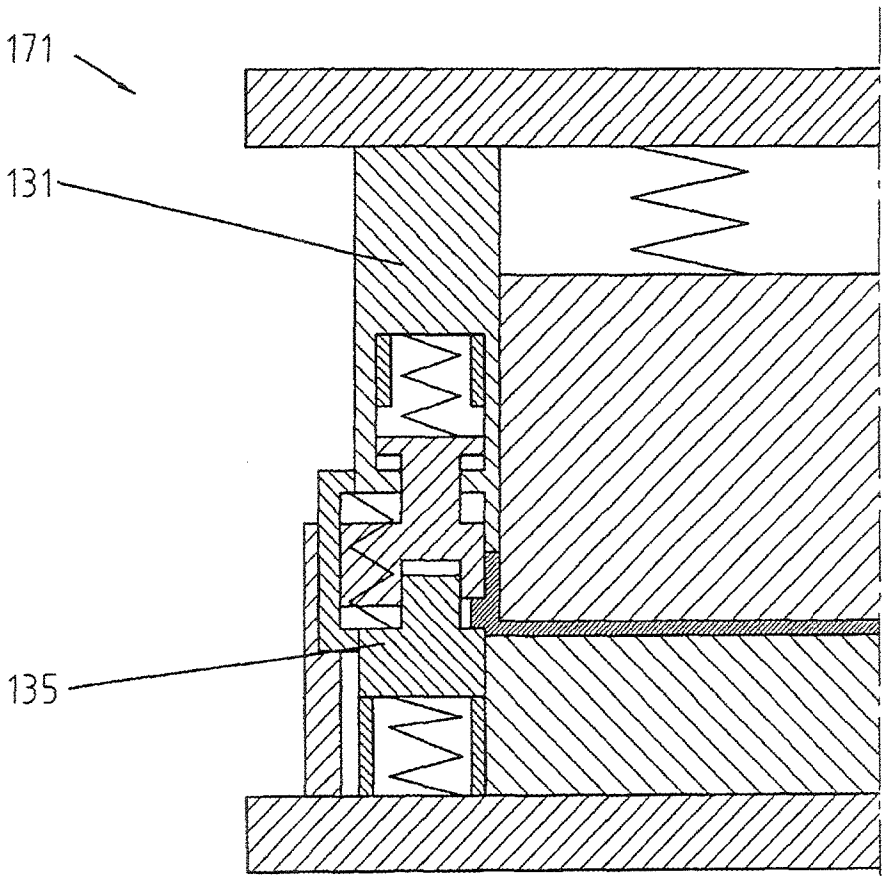
FIG. 19 shows a further state of the tool according to FIG. 17.
Figure 20:
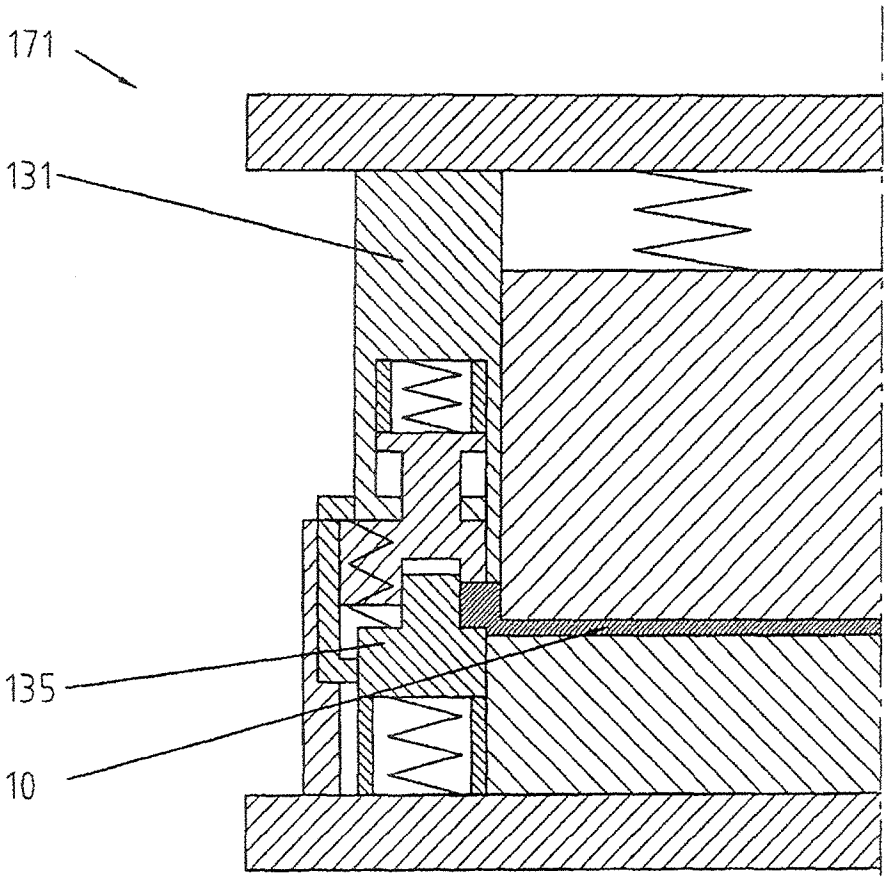
FIG. 20 shows a further state of the tool according to FIG. 17.

FIG. 16 shows an illustration in which the installation according to FIG. 13 and comprising the tool 130 has already moved the lower outer wall support body 135 to its full extent as far as a point at which a counterholder 140 delimits the path. The same applies to the upper outer wall support body 134 and the counterholder 141. The region between the support bodies 134 and 135, which is available as a die cavity, has thus been expanded, so that an end cavity 142 is provided for forming the structure.

FIGS. 17, 18, 19 and 20 show a further embodiment of a tool 171 according to the invention. In this case, a further spring ballast 170 has been introduced between the lower wall support body 135 and the upper punch 131 compared to the previous illustration. As illustrated in FIGS. 17 to 20, in the method according to the invention, the initial cavity 172 is thus moved during the forming process along the wall surface of the preform 2 and its available volume changes. On the one hand, buckling of the wall of the thin-walled preform 2 is thus prevented, and on the other hand the volume flow required to form the structure in the cavity is optimized to short flow paths, for example since not all of the material has to be transported over the entire wall height x of the preform. Mold filling is also improved by similar friction conditions on both sides of the cavity. Dynamic enlargement of the cavity is achieved with corresponding adaptation of the force parameters of the respective spring ballasts.

The movement of the movable tool elements in FIGS. 3 to 5, 6 to 8 and 13 to 20 can be controlled alternatively by drive shafts, die cushions or other force or path actuators, besides the stops, spring ballasts, displacement pins, thrust pins and counterholders presented herein.

LIST OF REFERENCE SIGNS

1 planar blank
2 preform
3 wall height x
4 wall thickness t1
5 wall
6 cup shape
7 base part
8 opening
9 segment section, L-shaped/U-shaped cross-sectional symmetry
10 component
11 support
12 support surface
13 structure (for example teeth and/or thickening)
14 teeth
20 tooth width b
21 wall thickness of the support t2
22 tooth height h
29 forming installation
30 tool
31 upper punch
32 lower punch

33 upper forming force
34 lower forming force
35 axis of symmetry
36 downwards direction of movement
37 upwards direction of movement
40 outer wall surface
41 inner wall surface
42 inner wall support body
43 upper edge of the wall
44 outer wall support body
45 die cavity
46 radial direction
47 stop for upwards movement of the outer wall support body
48 upper pressure piston
49 lower pressure piston 50 upsetting process
51 structure formed by material displaced by the forming process
52 thrust ring
53 die cavity
54 height of the die cavity
55 volume of the die cavity
60 tool
61 upper punch
62 lower punch
63 inner wall support body
64 die cavity
65 initial height of the die cavity
66 outer wall support body
67 spring ballast
70 spring ballast
71 end height of the die cavity
100 component
101 outer toothing
102 wall
103 groove for adjusting spring
105 elliptical components
110 component
111 component
112 outer toothing
113 outer flange
114 inner toothing
115 inner flange
116 inner toothing
117 outer toothing
130 tool
131 upper punch
132 lower punch
133 inner wall support body
134 upper outer wall support body
135 lower outer wall support body
136 cavity
137 initial cavity height
138 upper spring ballast
139 lower spring ballast
140 counterholder
141 counterholder
142 end cavity height
170 spring ballast
171 tool
172 initial cavity

The invention claimed is:

1. A method for producing a component formed from a thin-walled preform, the method comprising:

placing the preform in a tool for forming the component, the preform consisting of a metal material and having a wall with a first height x and a first, radially measured wall thickness t1, wherein the tool comprises at least one inner wall support body, at least one outer wall support body, at least one upper punch and at least one lower punch for exerting a forming force and at least one die cavity for receiving material of the preform displaced during the forming step, closing the tool in such a way that the inner wall support body is positioned against an inner wall surface of the preform, and the outer wall support body is positioned against an outer wall surface of the preform, and the preform is enclosed between the upper punch and the lower punch, heating the preform at least one of before and during the forming step so that the forming step is one of a warm-forming and a hot-forming, and forming the preform into the component by an effect of the forming force of the punch, wherein the component comprises a support and a structure connected to the support and surrounding a support surface, at least in part, wherein, during the forming step, the wall of the preform is upset from the first height x to a second, smaller height b, and material of the wall of the preform substantially fills the at least one die cavity, and a corresponding radially measured wall thickness t2 of the component is at least equal to the first wall thickness t1 of the preform, and wherein material of the wall of the preform outside of the at least one die cavity is pushed into the at least one die cavity and the inner wall support body and the outer wall support body provide support and prevent buckling of the wall of the preform during the forming step.

2. The method as claimed in claim 1, wherein the preform is produced from a planar blank.

3. The method of claim 2, wherein the planar blank is formed into the preform by deep-drawing.

4. The method of claim 2, wherein the planar blank is a sheet metal.

5. The method of claim 2, wherein the preform has an L-shape in segment section.

6. The method of claim 5, wherein the preform has a U-shaped cross-sectional symmetry.

7. The method of claim 6, wherein the U-shaped cross-sectional symmetry has a cup shape.

8. The method of claim 7, wherein the cup shape has a peripheral wall and a base and the cup shape is formed as one of an elliptical body, a circular body and an irregular body.

9. The method of claim 8, wherein the base is not completely closed.

10. The method as claimed in claim 1, wherein a position of at least one of the inner wall support body and the outer wall support body is held in a stationary manner relative to one of a base surface and an end face of the preform during the forming step.

11. The method as claimed in claim 1, wherein a position of at least one of the inner wall support body and the outer wall support body adjacent to the die cavity relative to one of a base surface and an end face of the preform is changed during the forming step.

12. The method of claim 11, wherein at least one of the inner wall support body and the outer wall support body moves parallel in relation to the movement of at least one of the at least one upper punch and the at least one lower punch during the forming step.

13. The method as claimed in claim 1, wherein the upper punch is held in a stationary manner and the lower punch is moved with the preform to press the preform against the upper punch during the forming step.

14. The method as claimed in claim 1, wherein the lower punch is held in a stationary manner and the upper punch, is moved to press the preform against the lower punch during the forming step.

15. The method of claim 14, wherein the upper punch is a thrust ring.

16. The method as claimed in claim 1, wherein the at least one die cavity is moved during the forming step in relation to a movement of an upper edge of the wall of the preform being formed into the component.

17. The method as claimed in claim 1, wherein the volume of the at least one die cavity is increased during the forming step.

18. The method of claim 17, wherein the at least one die cavity increases in height.

19. The method as claimed in claim 1, wherein when the tool is closed the positioning of the inner wall support body and the outer wall support body provide support to the wall of the preform, except for at least one portion of the wall opposite to the at least one die cavity, to prevent buckling of the wall of the preform during the forming step.

* * * * *